US005597791A

United States Patent [19]

Richards et al.

[11] Patent Number: 5,597,791

[45] Date of Patent: Jan. 28, 1997

[54] STABLE PERACID SOLS, GELS AND SOLIDS

[75] Inventors: Joseph C. Richards, Cranbury; William A. Hills, Lawrenceville, both of N.J.; William C. Snow, Rockland, Me.

[73] Assignee: FMC Corporation, Philadelphia, Pa.

[21] Appl. No.: 322,635

[22] Filed: Oct. 13, 1994

[51] Int. Cl.[6] ..... C11D 3/22; C11D 3/39; C11D 3/395; C11D 7/38

[52] U.S. Cl. ..... 510/372; 510/375; 510/403; 510/417; 510/445; 510/470

[58] Field of Search ..... 252/186.26, 186.42, 252/311, 315.3, 95, 104, 174.17

[56] References Cited

U.S. PATENT DOCUMENTS

| | | | |
|---|---|---|---|
| 959,605 | 5/1910 | Queisser . | |
| 2,347,434 | 4/1944 | Reichert et al. | 260/502 |
| 2,609,391 | 9/1952 | Greenspan et al. | 260/502 |
| 3,130,169 | 4/1964 | Blumbergs | 252/186.26 |
| 3,167,513 | 1/1965 | Van embden | 252/186.26 |
| 3,192,255 | 6/1965 | Cann | 260/502 |
| 3,248,336 | 8/1966 | Blumbergs | 252/186.26 |
| 3,499,844 | 3/1970 | Kibbel, Jr. et al. | 252/316 |
| 3,658,712 | 4/1972 | Lindner et al. | 252/99 |
| 3,749,673 | 7/1973 | Jones et al. | 252/174 |
| 3,852,210 | 12/1974 | Krezonoski | 252/95 |
| 3,996,152 | 12/1976 | Edwards et al. | 252/186 |
| 4,017,411 | 4/1977 | Diehl et al. | 252/186 |
| 4,100,095 | 7/1978 | Hutchins et al. | 252/99 |
| 4,130,501 | 12/1978 | Lutz et al. | 252/186 |
| 4,528,180 | 7/1985 | Schaeffer | 424/52 |
| 4,681,592 | 7/1987 | Hardy et al. | 8/111 |
| 4,837,008 | 6/1989 | Rudy et al. | 424/53 |
| 4,879,057 | 11/1989 | Dankowski et al. | 252/99 |
| 5,102,571 | 4/1992 | Mole et al. | 252/99 |
| 5,122,365 | 6/1992 | Murayama | 424/49 |
| 5,160,448 | 11/1992 | Corring | 252/95 |
| 5,358,654 | 10/1994 | Torenbeek et al. | 252/95 |

OTHER PUBLICATIONS

Lewis, Richard J. *Hawley's Condensed Chemical Dictionary* Twelfth Ed; 1993 p. 236.

*Primary Examiner*—Paul Lieberman
*Assistant Examiner*—Gregory R. Del Cotto
*Attorney, Agent, or Firm*—Richard E. Elden; Patrick C. Baker; Robert L. Andersen

[57] ABSTRACT

The invention provides an aqueous colloidal peroxygen composition comprising stable sols, gels and solids of C2 to C6 peroxycarboxylic acids with a polysaccharide gum, optionally with gum cross-linking agents such as boric acid, borate salts, urea and the like useful for delivering peracids in applications such as surface cleaners, detergent bleach, automatic dish washing formulations and the like. The compositions are particularly useful for sanitizing or bleaching at an acid or neutral pH compared with other chlorine or peroxygen bleach compounds.

15 Claims, No Drawings

STABLE PERACID SOLS, GELS AND SOLIDS

The present invention is a process to form a stable aqueous sol or gel containing a peracid.

Environmental concerns about the effects of certain chemicals on the upper atmosphere has led to some unease about the widespread use of chlorine bleach. Hydrogen peroxide, peracetic acid, persulfates and peroxyhydrates, such as sodium perborate are well known as alternative bleaching compounds to available chlorine compounds but have not been found suitable to replace liquid chlorine bleach.

Hydrogen peroxide would be ideal because its end-products are only water and oxygen. However, to act as a bleach it is necessary to increase the pH of the solution to at least 7 or 8; at that pH the hydrogen peroxide solution is not storage stable. Peracetic acid, even at a lower pH, is an even more powerful oxidizing agent than hydrogen peroxide, but it is difficult to handle because of its strong odor and because it can cause chemical "burns" if splashed onto the skin. The persulfates and inorganic peroxyhydrates generally contribute undesired dissolved solids to the effluent when they are employed.

It is particularly desirable that a bleach be available for use as a single, stable gel or a viscous solution (sol), although a solid would be satisfactory if it were biodegradable, easily soluble in water, and did not contain significant inorganic dissolved solids such as are provided by sodium persulfate or sodium perborate. It is also desirable for the bleach to have less odor than peracetic acid.

Highly viscous hydrogen peroxide sols are well known. U.S. Pat. No. 959,605 to Queisser (1910) discloses that vegetable gums were well known at that time to be useful for thickening and gelling hydrogen peroxide. The patent also teaches incorporating burnt gypsum which by hydrating further stabilizes the hydrogen peroxide and the hydrated gypsum is useful as an abrasive. U.S. Pat. No. 3,658,712 to Lindner (1972) claims a stable thickened aqueous suspension of Sodium perborate of polymers containing carboxyl groups, preferably a polycarbonate polymethacrylate. The specific polymer, Carbopol 934, was cited as the thickening agent. U.S. Pat. No. 5,102,571 to Mole et al. (1992) teaches an aqueous solution or suspension of sodium perborate tetrahydrate thickened to form a mobile fluid, or a highly viscous paste or gel. The thickening agents disclosed were a hydroxyalkyl cellulose, polysaccharides (i.e. xanthan and galactomannan gums), fumed silica and clays, plus a dispersing agent such as a sodium salt of polyacrylic acid. In addition to the above, there are two patents claiming stable, thickened hydrogen peroxide sols, U.S. Pat. Nos. 3,499,844 and 4,130,501 which employ polyacrylics (the latter with an added surfactant). However, to be useful as a bleach these sols require further compounding to increase the pH to at least 8, or must be packaged in an expensive two-compartment package. On the other hand, thickened perhydrate suspension, such as the sodium perborate composition of U.S. Pat. No. 3,658,712 contributes undesirable non-biodegradable dissolved solids to the environment, including phytotoxic borate ions.

Other prior attempts to provide a peroxygen-based bleach have included gelled suspensions of substantially insoluble peracids, such as diperazelic acid (U.S. Pat. No. 3,996,152). The patent discloses that the water-insoluble peracids require salt-forming alkaline conditions to provide a solution of the active oxygen bleaching species. In general peracids themselves are effective bleaching agents even at a low pH, provided they are solubilized.

U.S. Pat. No. 4,879,057 attempts to overcome some of the disadvantages of the product of U.S. Pat. No. 3,996,152 by providing pourable to pasty aqueous bleaching agent suspensions which have practically no solid/liquid phase separation and only a slight loss of available oxygen, even after two weeks of storage. The patent teaches a composition comprising an aqueous carrier liquid, a particulate, practically water-insoluble peroxycarboxylic acid, an organic thickening agent (starch) and an acidifying agent, which is characterized in that it contains a xanthan polysaccharide or agar polysaccharide as thickening agent and a hydrate-forming neutral salt which desensitizes peroxycarboxylic acids, such as sodium sulfate, sodium phosphate, sodium borate or the like. The bleaching agent still requires the alkaline conditions, provided by a laundry detergent to dissolve the peracid sufficiently to provide bleaching conditions.

The present invention overcomes the problems of the prior art by providing an aqueous colloidal peroxygen composition comprising stable sols, gels and solids of C2 to C6 peroxycarboxylic acids with a polysaccharide gum and optionally comprising polysaccharide gum cross-linking agents such as boric acid, borate salts, urea and the like. Such compositions form carriers for delivering peroxycarboxylic acids in applications such as surface cleaners, detergent bleach, automatic dish washing formulations and other cleaning applications. The compositions are particularly useful for sanitizing or bleaching at an acid or neutral pH compared with other chlorine or peroxygen bleach compounds.

It was unexpected from the prior art that thickened sols, gels or solids could be made from a water-soluble peroxycarboxylic acid (peracid) such as peracetic acid. It was particularly unexpected that storage stable thickened peracetic acid compositions could be prepared because such peracids are very strong oxidizing agents even at a pH of 2 to 8, unlike hydrogen peroxide which is a reducing agent in that pH range, because the water soluble peracids are far less stable than hydrogen peroxide, decomposing to form free radicals which tend to depolymerize large molecules such as polysaccharides and hydrolyze esters. Heretofore, stable polysaccharide gels or sols have been made containing hydrogen peroxide but none are reported containing a water soluble peracid. There is no suggestion in the prior art that a solid peracid composition could be prepared.

It is well known that aqueous peracids are an equilibrium composition. For peracetic acids the equilibrium is represented as follows:

$$CH_3COOH+H_2O_2 \Longleftrightarrow CH_3COOOH+H_2O$$

The rate of the equilibrium reaction is very slow unless in the presence of a catalyst, such as a strong acid. Usually it is sufficient for a stability determination to determine only the total active oxygen of the compositions. It is, of course, preferable for some purposes to know the concentration of the peracid as well as the total active oxygen concentration.

For the purpose of this invention a "stable" sol, gel or solid peracid composition is one which maintains sufficient physical properties (viscosity) and active oxygen content long enough to be useful, at least 24 hours. To be "storage stable" the sol, gel or solid peracid composition should maintain at least 90% of its viscosity and active oxygen content for one month.

Any C2 to C6 percarboxylic acid which is water soluble may be incorporated into the compositions. Examples, include peracetic acid, perproprionic acid, perbutyric acid, pervaleric acid, percaproic acid, and the like and derivatives thereof.

Konjac and locust bean gums are typical neutral polysaccharides; they are natural products obtainable in a range of forms and degrees of purity. Konjac gum may include konjac flour, purified konjac gum and derivatives thereof. Locust bean gum also may include a variety of purities and derivatives. Carrageenans are another variety of polysaccharides derived from seaweed. Carrageenans carry sulfate half-ester groups and form gels in the presence of cations. Three forms are available commercially, kappa, iota and lambda.

Cross-linking agents for gums and polymers are well known in the art and include compounds such as polyfunction cations and anions. Particularly desirable are cross-linking agents which do not catalyze the decomposition of peroxygens such as borates and other chaotrophic agents, including urea, biuret and the like.

Having described the best mode of practicing the invention the following examples are provided to illustrate the invention and not as a limitation thereof.

EXAMPLES

All the preparations were made under normal ambient laboratory conditions, approximately 1 atmosphere pressure and room temperature (17° C. to 25° C. ). Vacuum drying when employed was at 40° C. and from 3.5 to 10 kPa absolute. However, it is well known that some peracids, particularly peracetic acid, are more volatile than the corresponding acid or hydrogen peroxide. Therefore, it is necessary to ensure that vacuum drying be closely monitored to avoid extracting substantial amounts of the peracid also.

Formulations of 1% to 4% peracids were prepared by adding the peracid to an aqueous sol which was in the process of thickening.

The visual appearance of a gel was determined qualitatively either as clear, or turbid (containing a haze but not opaque).

Unless otherwise indicated all proportions are by weight.

EXAMPLE 1

Cross-linked Konjac Flour/Boric Acid Gel were prepared from 43.42 g of approximately 5% peracetic acid, 0.43 g of crude konjac flour and 0.22 g of boric acid which were mixed with gentle stirring. A thick, clear gel formed. The gel contained 5.22% peracetic acid.

The gel was stable over one week. Even though the viscosity dropped, the gel retained 96% (5.01% PAA) of its peracetic acid.

EXAMPLE 2

Konjac Flour Gel (Not Cross-linked) was prepared from 43.42 g of approximately 5% peracetic acid and 0.43 g of konjac flour by mixing as in Example 1. Boric acid was omitted as the cross-linking agent. A gel formed, however, the viscosity was much lower than the cross-linked gel prepared in the previous example.

Stability and assay were almost identical to the cross-linked gel prepared above.

EXAMPLE 3

Locust bean gum was prepared by reacting 40.75 g of approximately 5% peracetic acid, 0.40 g of crude locust bean gum suspended in 0.51 g of isopropyl alcohol. A gel was formed almost instantly when the mixture was stirred. The gel contained 5.14% peracetic acid and was stable for approximately one week. Even though the gel broke after one week there was less than a 5% loss of peracetic acid (a 95% retention).

EXAMPLE 4

Locust Bean Gum/Boric Acid Gel (Cross-linked) was prepared according to Example 3, with the addition of boric acid as a cross-linking agent. A gel with a peracetic acid content of 5.06% was obtained. It was stable over a one week period. Even though there was considerable loss of viscosity, there was practically no loss of peracetic acid.

EXAMPLE 5

A Konjac Flour/Urea Gel was prepared by mixing 40.14 g of approximately 5% peracetic acid, 40.01 g of urea and 1.6 g konjac flour. A viscous gel formed immediately. The gel contained 3.03% peracetic acid. The gel was dried under reduced pressure (10 kPa/40° C.) yielding a hygroscopic solid (PAA 1.08%). This solid dissolved in water. Approximately 36% was retained.

EXAMPLE 6

A cross-linked Peracetic Acid/Locust Bean Gum/Urea/Boric Acid Gel was prepared according to Example 5 by reacting 41.77 g of 5% peracetic acid, 41.25 g urea, 1.62 g konjac flour and 0.8 g of boric acid with gently stirring. A viscous gel formed. It analyzed at 3.44% of peracetic acid. The gel was dried to a solid which analyzed for 1.71% peracetic acid. The solid dissolved slowly in water. The solid was very stable with or without urea.

EXAMPLE 7

A Peracetic Acid/Locust Bean Gum-cross-linked (Increased Active Oxygen) was prepared when 43.06 g of 5% peracetic acid, 1.72 g of locust bean gum and 0.22 g of boric acid were stirred together. A gel formed. The gel was dried under vacuum 40° C. at 3.5 kPa to give a solid containing 10.64% peracetic acid.

EXAMPLE 8

A 2% konjac sol was prepared by mixing konjac and 40 g of a 50% by weight urea solution. A gel formed after the addition of 40 g of a 5% peracetic acid (PAA) solution which assayed 8.87% $H_2O_2$ and 3.03% PAA. After 1 week the gel had thinned somewhat and assayed 9.38% $H_2O_2$ and 1.86% PAA indicating that while some of the peracetic acid was converted to hydrogen peroxide, there was essentially no loss of active oxygen.

A sample was vacuum lined to a hand, slightly tacky solid was obtained having a faint odor of acetic acid. The solid assayed 24.27% $H_2O_2$ and 1.08% PAA. After 390 days' storage the solid assayed 17.70% $H_2O_2$ and 0.27% PAA indicating an unexpectedly great stability.

EXAMPLE 9

A series of carrageenan gels of PAA were prepared as above containing 1% sodium or magnesium sulfate to assist the rate of gelation. The pH, odor, gel condition and assay after 2 weeks' storage were compared with the initial evaluation as shown in Table I. The gels contained 9A sodium iota carrageenan; magnesium sulfate 9B sodium iota carrageenan, sodium sulfate 9C kappa carrageenan; magnesium sulfate 9D kappa carrageenan; sodium sulfate 9E sodium iota carrageenan; DEQUEST 2066

9F kappa carrageenan; DEQUEST 2066.

This example shows that peracetic acid gels can be prepared with carrageenan which retains both a usable PAA assay and gel characteristics for at least two weeks. The gels were also evaluated for odor on an arbitrary scale of 5 (PAA) to 0 (no odor). It is particularly surprising that some of the PAA gels had a reduced odor compared to peracetic acid at the same concentration. Odor generally was evaluated up to 24 hours after a gel was prepared.

TABLE I

ASSAY OF CARRAGEENAN GELS INITIALLY (I) AND AFTER 2 WEEKS (F)

| Example | | pH | Assay % $H_2O_2$ | % PAA | % AO | Odor* | Comments |
|---|---|---|---|---|---|---|---|
| 9A | I | 3.77 | 1.86 | 1.27 | 1.14 | 5 | Thick, |
| | F | | 1.85 | 0.30 | 0.93 | | clear |
| 9B | I | 3.98 | 1.98 | 1.34 | 1.21 | 4 | Pourable, |
| | F | | 1.80 | 0.21 | 0.89 | | clear |
| 9C | I | 4.20 | 1.09 | 0.88 | 1.06 | 2 | Thick, |
| | F | | 1.53 | 0.12 | 0.75 | | turbid |
| 9D | I | 4.39 | 1.68 | 0.64 | 0.92 | 2 | Thick, |
| | F | | 1.45 | 0.14 | 0.71 | | turbid |
| 9E | I | 4.31 | 1.76 | 1.15 | 1.07 | 5 | Thick, |
| | F | | 1.56 | 0.40 | 0.82 | | clear |
| 9F | I | 3.96 | 1.92 | 1.39 | 1.20 | 2 | Pourable, |
| | F | | 1.44 | 0.26 | 0.73 | | turbid |

*Odor evaluated on an arbitrary scale of 5 (maximum) to 0 (no odor).

EXAMPLE 10

Konjac gels were prepared evaluating tetrasodium pyrophosphate (TSPP), a glassy phosphate (Glass H-TM FMC Corporation with an average chain length of 21), magnesium sulfate or urea as gel stabilizers. The gels were prepared by adding about 1 g of the stabilizer to 100 g of 1% peracetic acid (PAA) and forming a gel by adding 2 g konjac (BRE-1036 -TM FMC Corporation).

The gels were evaluated after 5 days as follows:

Example 10A

A TSPP-containing gel originally was clear and thick, but had thinned after 5 days. The final assay was 5.40% $H_2O_2$ and 0.95% PAA.

Example 10B

The Glass-H-containing gel remained clear and thick. The final assay was 5.40% $H_2O_2$ and 1.16% PAA.

Example 10C

The gel containing magnesium sulfate was turbid. After 5 days the gel had thinned slightly; the assay was 5.49% $H_2O_2$ and 1.05% PAA.

Example 10D

The gel containing urea was very thick and was clear. After 5 days the gel was at least as thick as that of Sample 10B. The assay was 5.77% $H_2O_2$ and 1.08% PAA.

This example shows that 1% PAA gels can be formulated with a variety of gel stabilizers and retain both the rheological properties and active oxygen for a sustained period.

We claim:

1. An aqueous colloidal peroxygen composition consisting essentially of a sufficient amount to provide up to about 5% by weight of a water-soluble C2 to C6 unreacted peroxycarboxylic acid with a sufficient amount of a polysaccararide gum selected from the group consisting of konjac gum, locust bean gum and carrageenan gum to form viscous solutions, gels and solids thereof, and optionally containing a gel-assisting cross-linking agent.

2. The composition of claim 1 wherein the composition is a viscous sol.

3. The composition of claim 1 wherein the composition is a gel.

4. The composition of claim 1 wherein the composition is sufficiently dehydrated to be a solid containing up to about 11% by weight of the peroxymonocarboxylic acid.

5. The composition of claim 1 wherein the gel-assisting agent is boric acid.

6. The composition of claim 1 wherein the gel-assisting agent is a borate salt.

7. The composition of claim 1 wherein the gel-assisting agent is urea.

8. The composition of claim 1 wherein the gel-assisting agent is magnesium sulfate.

9. The composition of claim 1 wherein the gel-assisting agent is sodium sulfate.

10. The process of forming a stable colloidal solid comprising the steps of incorporating a polysaccharide gum selected from the group consisting of konjac gum, locust bean gum and carrageenan gum into water to form an aqueous gel, adding thereto a sufficient amount of an aqueous, water solubles C2 to C6 unreacted peroxymonocarboxylic acid solution to provide up to about 5% by weight peracetic acid therein, and forming a colloidal solid containing up to about 11% by weight of the peroxymonocarboxylic acid by vacuum drying the gel containing the peroxymonocarboxylic acid.

11. An aqueous colloidal peroxygen composition consisting essentially of a sufficient amount to provide up to about 5% by weight unreacted water soluable peracetic acid with a sufficient amount of a polysaccharide gum selected from the group consisting of konjac gum, locust bean gum and carrageenan gum to form viscous solutions, gels and solids thereof.

12. The aqueous colloidal peroxygen composition of claim 11 further consisting essentially of gel-assisting agents for the polysaccharide gum.

13. The composition of claim 11 wherein the composition is a viscous sol.

14. The composition of claim 11 wherein the composition is a gel.

15. The composition of claim 11 wherein the composition is sufficiently dehydrated to be a solid.

* * * * *